US005830038A

United States Patent [19]

Fekete et al.

[11] Patent Number: 5,830,038

[45] Date of Patent: Nov. 3, 1998

[54] MANUALLY OPERABLE FRONT GUIDE WHEEL STEERING IN A VEHICLE TOY

[76] Inventors: Ferenc Fekete; Kai Chung-Ho, both of 30/F, Room 3001-3, Natwest Tower, Times Square, 1 Matheson Street, Cuaseway Bay, Hong Kong

[21] Appl. No.: 824,989

[22] Filed: Mar. 27, 1997

[51] Int. Cl.[6] ..... A63H 17/38

[52] U.S. Cl. ..... 446/436; 446/460; 446/468

[58] Field of Search ..... 446/436, 431, 446/457, 460, 462, 464, 465, 468

[56] References Cited

U.S. PATENT DOCUMENTS

| | | | |
|---|---|---|---|
| 2,124,302 | 1/1938 | Lohr et al. | 46/211 |
| 2,146,708 | 9/1939 | Barrett | 46/213 |
| 2,168,788 | 8/1939 | Biller | 46/211 |
| 2,421,041 | 5/1947 | Swenson | 446/436 |
| 3,780,470 | 12/1973 | Roberts et al. | 46/213 |
| 3,909,276 | 9/1975 | Wolf | 46/244 R |
| 4,755,161 | 7/1988 | Yang | 446/436 |
| 5,320,574 | 6/1994 | Lahr et al. | 446/460 |

*Primary Examiner*—Robert A. Hafer
*Assistant Examiner*—Laura Fossom
*Attorney, Agent, or Firm*—Dorr, Carson, Sloan & Birney, P.C.

[57] ABSTRACT

This patent disclosure teaches a moving, vehicle toy having a hand operable selector knob that determines the direction of single guide wheel that is steered by the action of a pivotally mounted steering arm that is rotated by means of a lever arm that engages with any one of several cam surfaces of a powered cam shaft.

12 Claims, 6 Drawing Sheets

MANUALLY OPERABLE FRONT GUIDE WHEEL STEERING IN A VEHICLE TOY

BACKGROUND OF THE INVENTION

1. Field of the Invention

This invention generally relates to moving toys such as those having automobile, truck, airplane or animal configurations. It is particularly concerned with moving toys having a single front wheel whose direction is determined by the position of a selector knob.

2. Description of the Prior Art

Many moving toys, such as toy automobiles, have been provided with a third wheel that guides the toy in a variety of paths so that the operation of the toy is more amusing to a child. For example, U.S. Pat. No. 2,124,302 teaches a spring driven toy car having a fifth wheel that can be raised or lowered into contact with the ground. When so lowered, this fifth wheel becomes a "third wheel" that is centrally located between the front wheels and the rear wheels and upon which the front end of the car rides. This third wheel can be set at different angles by use of a control cam operated by a manually operated selector knob. The control cam, via a rather complex linkage system, provides differently shaped cam surfaces whose camming operations determine the angle at which the third wheel is turned. The control cam can be set at various operating positions such that the car will perform a variety of turning, circling and zigzagging movements.

U.S. Pat. No. 2,168,788 also teaches a toy car having a fifth wheel that can be lowered into contact with the ground to become a third wheel. The car has two levers whose operating positions control the car's various travel paths. In some modes of operation, a given position of the levers allows a spring to turn a wheel support, and hence the third wheel that is mounted in it, and thereby cause the car to turn in a given direction.

U.S. Pat. No. 2,146,708 teaches a toy car having a steering mechanism having wheels that are mounted on an axle mechanism that is guided, via a steering element, by two tie rods. The other end of each tie rod is connected to one end of an arm of a bell crank. The tie rods are respectively connected to the steering element and, hence, are capable of turning the steering element and the axle upon which a front wheel is mounted. The arm of the bell crank engages with powered gears that selectively engage a crank arm and thereby operate the tie rods to steer the car.

U.S. Pat. No. 3,780,470 teaches a toy vehicle having an operating mechanism to steer the front wheels of a vehicle as it travels forward under control of a flexible cord which is wound on a program drum having a multiplicity of pegs projecting from its surface. These pegs are arranged laterally in parallel circumferential rows. The cord is led from a storage spool around the program drum, and between the pegs, by an eye located on a lever arm that operates the steering mechanism.

U.S. Pat. No. 3,909,276 teaches a spring powered toy car that can be steered by operation of a string. The string, through the action of a lever arm/gear/drive shaft system, engages a roller mounted on one end of an extended arm whose other end becomes a tie bar that turns a bar upon which the front wheels of the car are mounted.

U.S. Pat. No. 5,320,574 discloses toy vehicles having steerable wheels that are carried on L-shaped wheel supports that are hinged to the vehicle's chassis. One branch of each of the L-shaped supports extends out from the chassis and carries one of the steerable wheels. The other branch of the L-shaped support extends substantially in the longitudinal direction of the vehicle. The branches of the steerable wheel supports are interconnected by a tie-bar which is hinged to branches of the steerable wheel supports about hinged axes. In its middle portion, the tie-bar also carries a control stud which extends rearward over a second outlet shaft of a reversible motor. The second outlet shaft has steering control teeth that are symmetrically disposed about the outlet shaft such that the weight of the control teeth is balanced about the outlet shaft. A control stud is positioned at a given distance from the second outlet shaft such that, when the motor rotates, the steering control teeth bear against a control stud and thereby urge it to the right or to the left depending on the direction in which the drive shaft of the motor is rotating.

U.S. Pat. No. 4,755,161 teaches a toy car having a motor that, in addition to driving the rear wheels, drives a geared annular hub whose periphery is provided with various protruding elements. These protruding elements contact an upper rod, or a lower rod, or neither, as the hub rotates. The protruding elements, in turn, contact an arm that operates transverse rods that turn a wheel steering mechanism.

The mechanisms by which the above-noted toys are steered in various travel paths are usually comprised of a large number of moving parts that are associated in rather complex mechanical systems that require many manufacturing operations to create—and a great deal of labor to assemble. It is therefore an object of this invention to provide moving toys that are capable of traveling in a variety of paths through use of a relatively simple drive and steering mechanism that can be quickly and, hence, inexpensively assembled.

SUMMARY OF THE INVENTION

The moving toys of this patent disclosure run upon a single, front guide wheel and two rear wheels. At least one of the rear wheels is propelled by a suitable motor such as a spring powered motor or a battery powered motor. In one particularly preferred embodiment of this invention, such a moving toy will have the general configuration of an automobile. Other possible configurations would include those of trucks, fire engines, airplanes, animals and the like. In any case, the moving toy is provided with a front guide wheel that is preferably located intermediate the toy's non-steering (and even non-functioning) front wheel and its rear wheels. This guide wheel extends lower than the non-steering front wheels and thereby places said guide wheel in contact with the "ground" or running surface upon which the toy travels. The steering direction of the guide wheel is obtained and controlled by a manually operable selector knob that is suitably positioned on the toy. Selection of a given operating position of this selector knob causes the toy to move forward in one of a variety of travel paths. In one particularly preferred embodiment of this invention, a windup spring motor powered toy automobile is provided with a mechanical steering mechanism that enables the toy to run (1) in a straight forward direction, (2) in a right-turning circle, (3) in a left-turning circle and (4) in a right curving and then left curving, etc. zigzagging travel path.

The selector knob terminates in a variety of selector knob cams that each serve to selectively position a lever arm with respect to various cam surfaces on a cam shaft that also is powered by the motor that propels the toy. The front end of the lever arm is slidingly attached to a pivotally mounted guide wheel steering arm. The rear end of the lever arm has a yoke-shaped rear end that engages in a camming action with one of several possible cam surfaces on the powered cam shaft. In one particularly preferred embodiment of this invention, the powered cam shaft has a series of four distinct camming surfaces. The first camming surface has a round, plate-like configuration. The second camming surface is rectangular or bar-like in configuration. The third camming surface has a round plate-like configuration and has a cross sectional diameter that is less than the cross sectional diameter of the first, round, camming surface. The fourth camming surface also has a round, drum-like configuration that has a cross sectional diameter that is larger than the cross sectional diameter of the third, round camming surface, but smaller than that of the first, round camming surface.

Operation of the manually operated selector knob forces one of its several cams against one side of the lever arm. In one particularly preferred embodiment of this invention, the lever arm resides between two lever arm guide devices. In either case, each position of the selector knob forces the lever arm to a different lateral position and thereby (1) causes the front end of the lever arm to slidingly move to a given location on one side of the pivotally mounted guide wheel steering arm and (2) causes the yoke-shaped rear end of the lever arm to come into camming contact with one of the various distinct camming surfaces on the powered cam shaft. Thus, the yoke-shaped rear end of the lever arm selectively serves as a cam follower with respect any given cam surface of the powered cam shaft.

The front end of the lever arm has a means for slidably attaching said lever arm (e.g., by means of a loosely fitting collar) to a first side of the pivotally mounted guide wheel steering arm. The opposite side of the pivotally mounted guide wheel steering arm is attached to a backwardly directed biasing device such as a coil spring. This biasing device pulls upon the opposite side of the pivotally mounted guide wheel steering arm. Thus, the first end of the pivotally mounted guide wheel steering arm is, to varying degrees, pulled by the lever arm as its yoke-shaped rear end cams against one of the multiple camming surfaces of the rotating cam shaft, but such pulling actions by the lever arm are opposed by the opposing pulling action created by the backwardly pulling spring.

A single guide wheel is mounted on the underside of the pivotally mounted guide wheel steering arm. Most preferably, this guide wheel is positioned at or near the pivot point of the pivotally mounted guide wheel steering arm. Therefore, as the pivotally mounted guide wheel steering arm is rotated about its pivot point, the guide wheel is steered in a given directions. For example, as the first or right side of the pivotally mounted guide wheel steering arm shown in FIG. 4 is pulled in one direction (e.g., clockwise) by the lever arm, the force of the biasing device (e.g., a coil spring) attached to the second or left side of the pivotally mounted guide wheel steering arm is overcome, and the guide wheel is rotated in a rightward direction and thereby steering the moving toy in a rightward direction. Conversely, when the pivotally mounted guide wheel steering arm is rotated in the opposite direction (e.g., counterclockwise) under the force supplied to the second or left side of the steering arm by the spring, the guide wheel is rotated to the left, and thereby steering the moving toy in a leftward direction.

The moving toy is preferably powered by a manually wound, spring powered, motor that is connected (via a gear train not shown) to at least one of the rear wheels of the toy. In one particularly preferred embodiment of this invention the spring powered motor will power both of the rear wheels and also serve as the source of power used to rotate the cam shaft upon which an array of distinct camming surfaces are found. Such a toy also could be driven by a battery powered motor, but in most instances a spring powered motor will provide the toy with a more reliable, less costly and more child-pleasing means of operation.

DETAILED DESCRIPTION OF THE INVENTION

Figure 1:
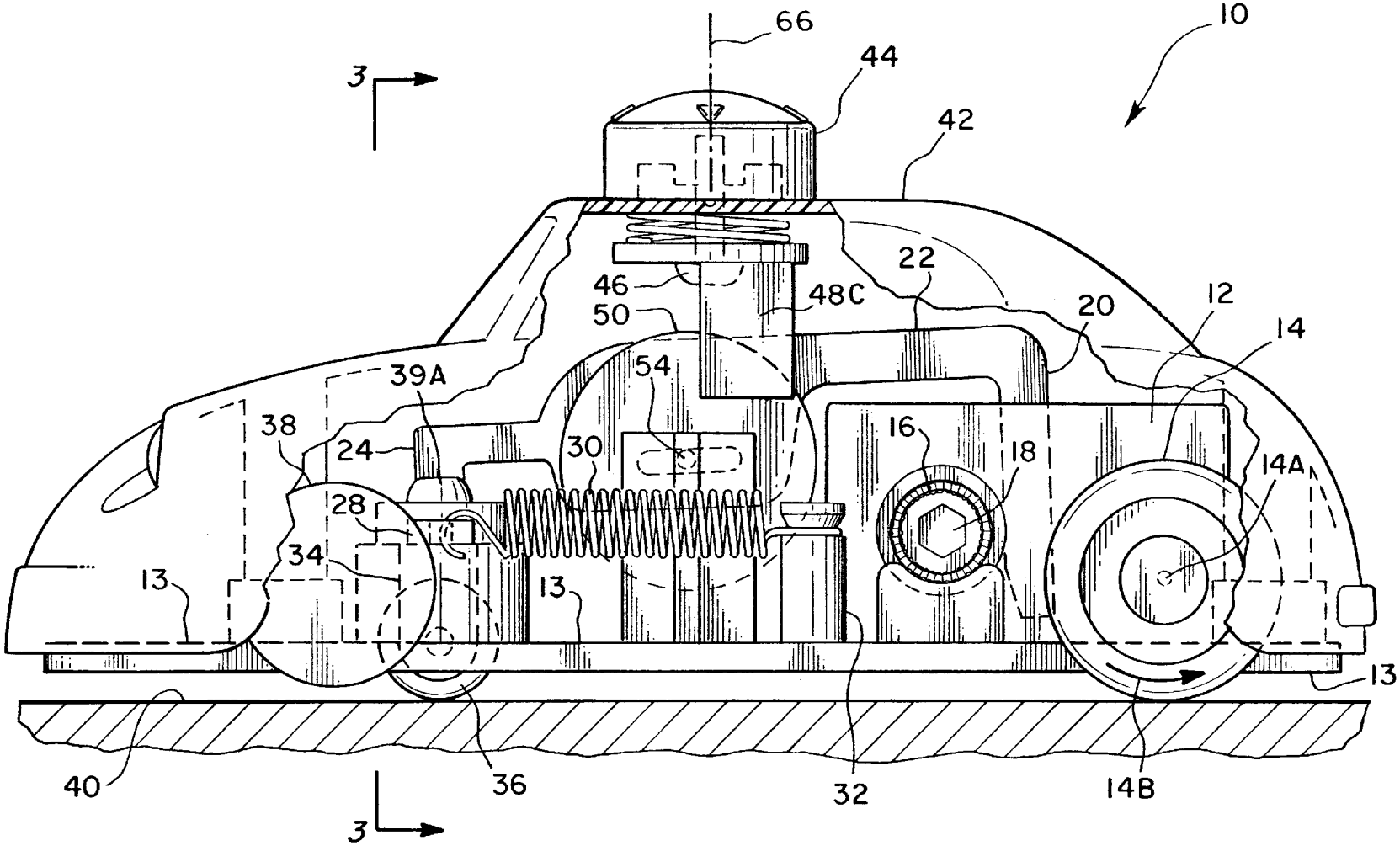
FIG. 1 is a left side view of a moving toy made according to the teachings of this invention and wherein said moving toy has the general configuration of an automobile.

FIG. 1 depicts a moving toy made according to the teachings of this patent disclosure. This particular moving toy has the general appearance of a toy automobile 10. This toy automobile 10 may be thought of as being powered by a spring powered motor 12 that preferably rests upon (or is mounted to) a base plate 13. Such spring powered motors are known to the toy manufacturing arts and, hence, the internal spring and gear systems of motor 12 are not shown. Be that as it may, the motor 12 turns at least one rear wheel e.g., rear wheel 14 of the toy automobile (or it may turn both rear wheels). The spring powered motor 12 is preferably wound up by means of a manually rotatable windup shaft 16. In one particularly preferred embodiment of this invention, this motor 12 also will power a cam shaft 18.

Figure 4:
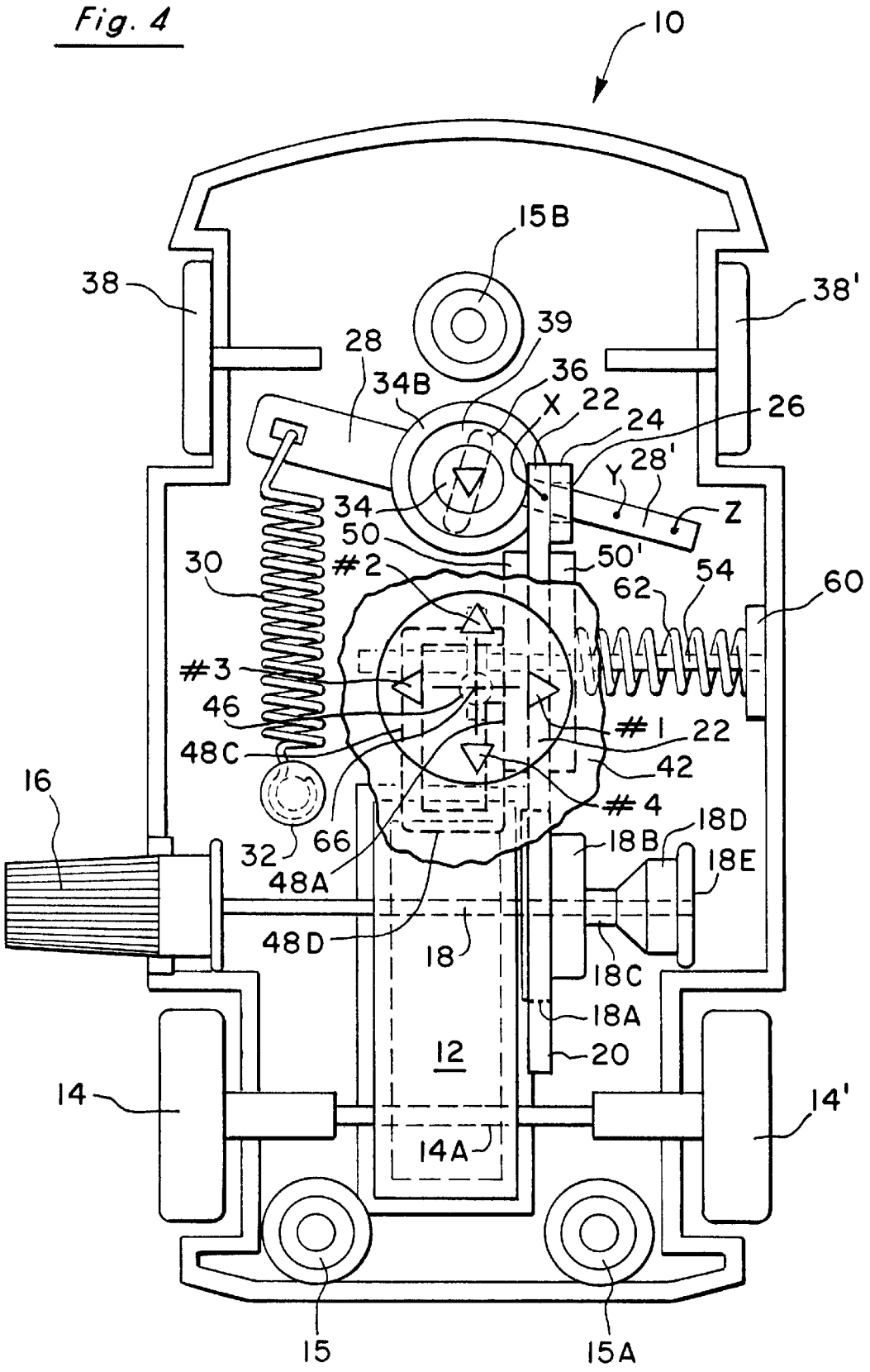
FIG. 4 is a plan view of the toy automobile shown in FIG. 2 with its steering mechanism in a first operating position whereby the toy is steered in a rightward circling direction.

This powered cam shaft is provided with a series of differently sized and/or configured camming surfaces. For example the powered cam shaft 18 may have 2, 3, 4 or more such cam surfaces. Each cam surface on the powered cam shaft 18 should be able to cammingly engage with a yoke-shaped rear end 20 of a lever arm 22. The front end of the lever arm 22 is provided with a laterally moveable slide device such as a collar 24 that slidingly engages with one side (the right side as seen in FIG. 4) of the pivotally mounted guide wheel steering arm 28. The other or left side of this pivotally mounted steering arm 28 is attached to one end of a biasing device, such as coil spring 30, whose other end is attached to fixed point on the toy such as mounting post 32. Preferably the mounting post is attached to a base plate 13 in a location such that the coil spring creates a force in a substantially backward pulling direction. The underside of the pivotally mounted guide wheel steering arm 28 is provided with a guide wheel mounting post 34 that terminates in a guide wheel 36 upon which the front end of the toy automobile 10 rests—and is guided. The nominal front wheels (38 and 38') of the toy automobile 10 need not be functional because they do not come into contact with "the ground" 40. The top 42 of the toy car 10 is shown provided with a manually rotatable selector knob 44. This selector knob 44 is, in turn, attached to a post 46 which terminates in an array of selector knob cams that provide a plurality of differently sized cams. Each of these cams will (depending on the operating position of the selector knob 44), preferably, abut against a guide device 50 which, in turn, abuts against the side of the lever arm 22. In a less preferred embodiment of this invention the guide device 50 may be eliminated and the selector knob cams may abut directly against the side of the lever arm 22.

Figure 2:
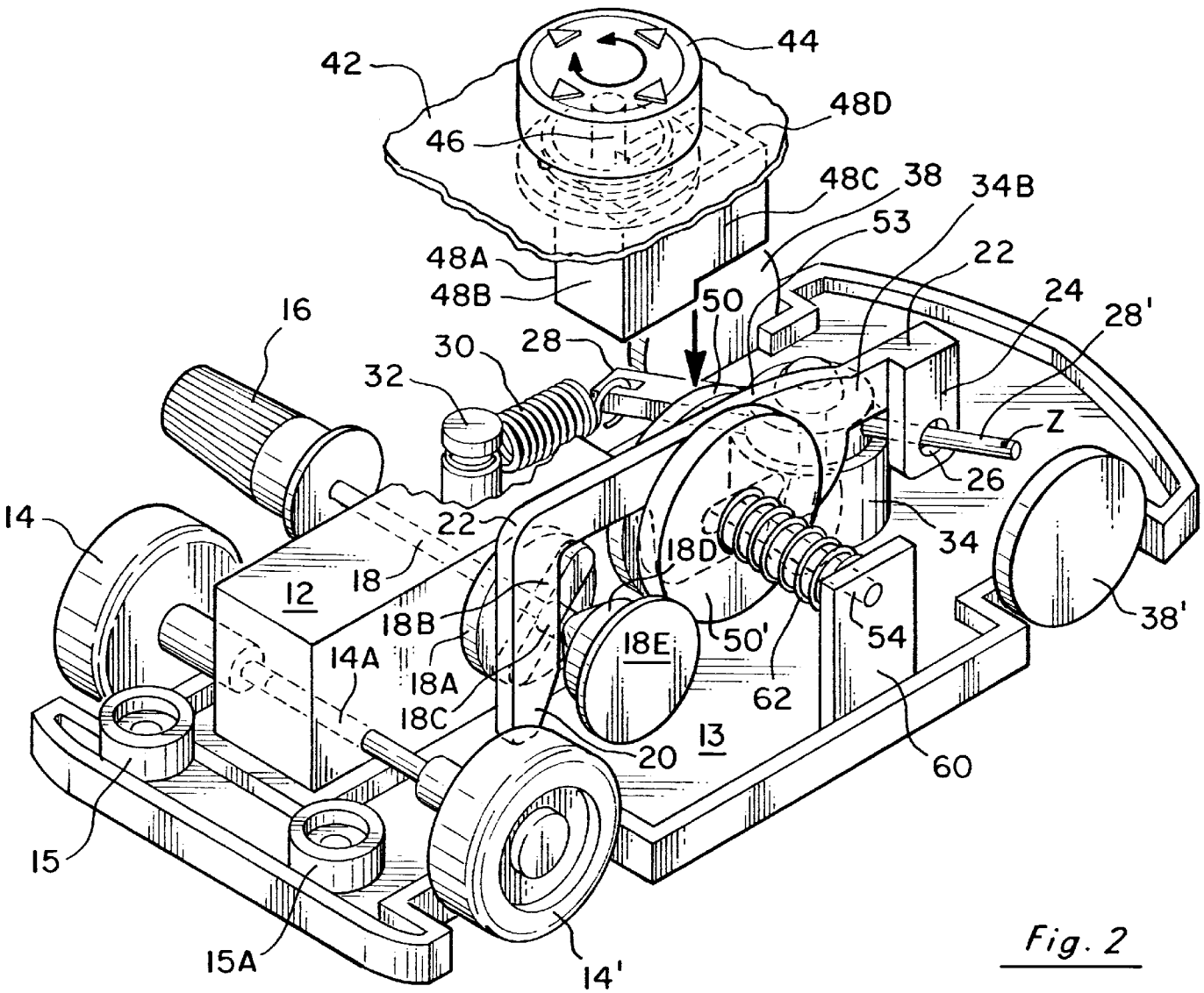
FIG. 2 shows a right side, perspective, cutaway, view of the toy automobile shown in FIG. 1 with most of its body removed in order to expose the various elements of its overall steering mechanism.

FIG. 2 is a right side, perspective, cutaway, view of the toy automobile 10 shown in FIG. 1. FIG. 2 depicts how lever arm 22 connects the pivotally mounted guide wheel steering arm 28 to the powered cam shaft 18. The rear end 20 of the lever arm 22 has a yoke-shaped configuration that is adapted to ride over the various camming surfaces 18A, 18B, 18C and 18D on cam shaft 18. Thus, the lower end of the yoke-shaped rear end 20 of lever arm 22 will partially encompass any given cam surface with which it is cammingly associated. By way of example, the yoke-shaped rear end 20 of lever arm 22 is shown in FIG. 2 cammingly riding upon cam surface 18C. A middle region of the lever arm 22 is shown residing in a space 53 formed by a guide system having two lever arm guides 50 and 50'. Use of these lever arm guides is optional; but if they are used they are preferably loosely mounted on a lateral axle 54. Thus, if used, these lever arm guides 50 and 50' can move laterally upon lateral axle 54 between post 58 (which can be seen in FIG. 3) and post 60. A lateral biasing means such as coil spring 62 is also preferably mounted on this lateral axle 54. Coil spring 62 serves to laterally bias lever arm guide 50'—and, hence, level arm 22 which resides next to lever arm guide 50'—toward mounting post 58 (again, see FIG. 3 for a better view of this arrangement). If lever arm guide 50' is not employed, coil spring 62 would directly bias lever arm 22 in the lateral direction toward mounting post 58. In either case, the lateral bias produced on lever arm 22 by coil spring 62 is opposed by a lateral force directed toward post 60 that is provided by a given cam 48A, 48B, 48C or 48D.

The upper end of shaft 46 upon which cams 48A, 48B, etc. are mounted is connected to a selector knob 44 that is preferably placed on the top 42 of the toy automobile 10 for easy manual access. FIG. 2 suggests that camming surface 48C is in an operating position such that, when said camming surface 48C is forced into an abutting relation with the left side of guide device 50, the lever arm 22 is forced toward post 60 a distance such that it falls into alignment with cam surface 18C. Movement of the lever 22 toward post 60 is opposed by the action of coil spring 62. Thus, each of the cams 48A, 48B, 48C, 48D, etc., by virtue of the fact that they have different widths W (see FIG. 3), will force the lever 22 toward post 60 by a distance comporting with the given width W of a given selector knob cam. Each such width W will place the lever arm 22 in alignment with a given cam surface (18A, 18B, 18C or 18D) on the powered cam shaft 18. As more clearly seen in FIG. 3, this width W may be thought of as being the distance from the center line 66 of post 46 to the cam "face" of a given cam.

Figure 6:
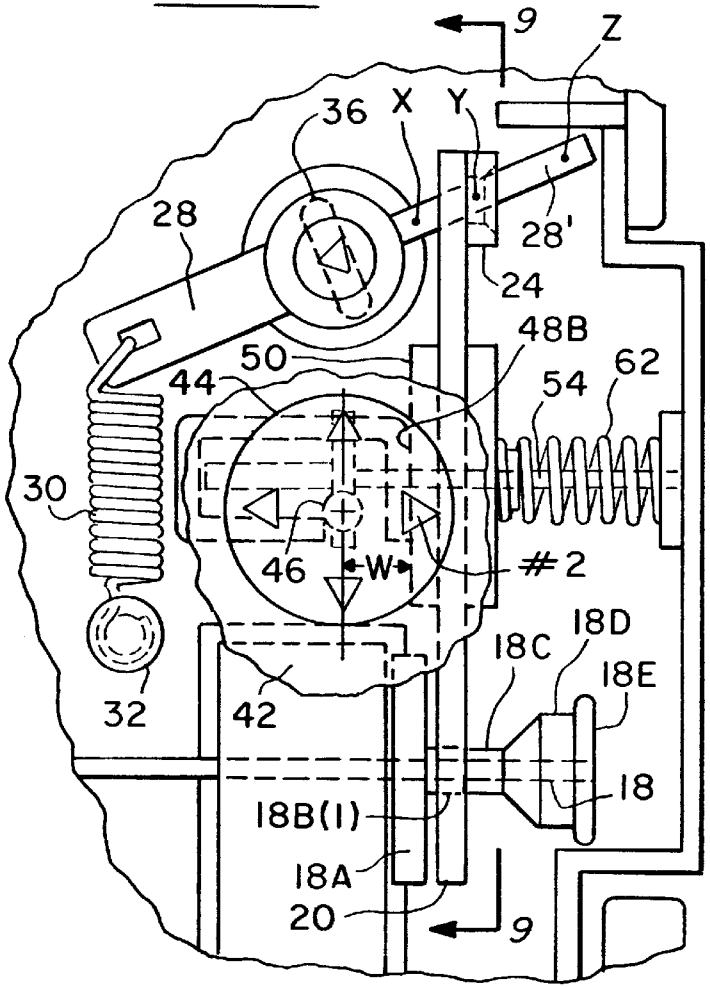
FIG. 6 is a plan view of the toy automobile shown in FIG. 2 with its steering mechanism in a third operating position whereby the toy automobile is steered in a leftward direction that forms a part of an overall, zigzagging, forward travel path.
Figure 7:
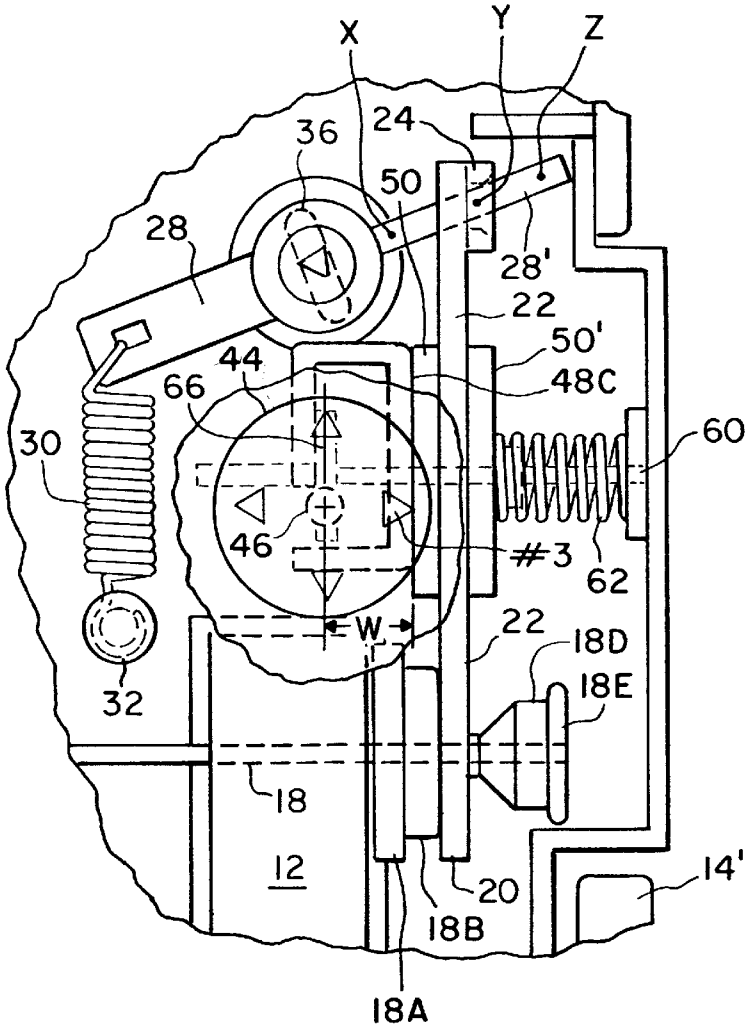
FIG. 7 is a plan view of the automobile shown in FIG. 2 with its steering mechanism in a fourth operation position whereby the toy is steered in a leftward circling direction.

Each selector knob cam 48A, 48B, 48C, 48D, etc. also is mechanically associated with a specific position or setting on the selector knob 44. For purposes of illustration only, selector knob 44 may be regarded as having four distinct positions (i.e., positions #1, #2, #3 and #4). Thus, as the selector knob 44 is manually rotated to each of its various operating positions, a different sized cam is forced against the left side of guide device 50. This, in turn, forces lever arm 22 into a given lateral position that is aligned with a given cam surface (18A, 18B, 18C, 18D, etc.) on the powered cam shaft 18. Thus, the lateral position of lever arm 22 is, in effect, defined by the lateral width W of the particular cam surface (48A, 48B, 48C, 48D) associated with a given selector knob position (#1, #2, #3 or #4). Again, by way of example only, FIG. 2 depicts the yoke-end 20 of the lever arm 22, riding in camming contact with camming surface 18C. In this particular position (owing to the relatively small diameter of cam 18C), the backwardly biased spring 30 is able to pull the pivotally mounted guide wheel steering arm 28 in a counterclockwise direction (as seen in FIGS. 6 and 7) and thereby turn guide wheel 36 in a counterclockwise direction so that the forward moving toy automobile 10 will turn in a generally leftward turning direction.

Figure 3:
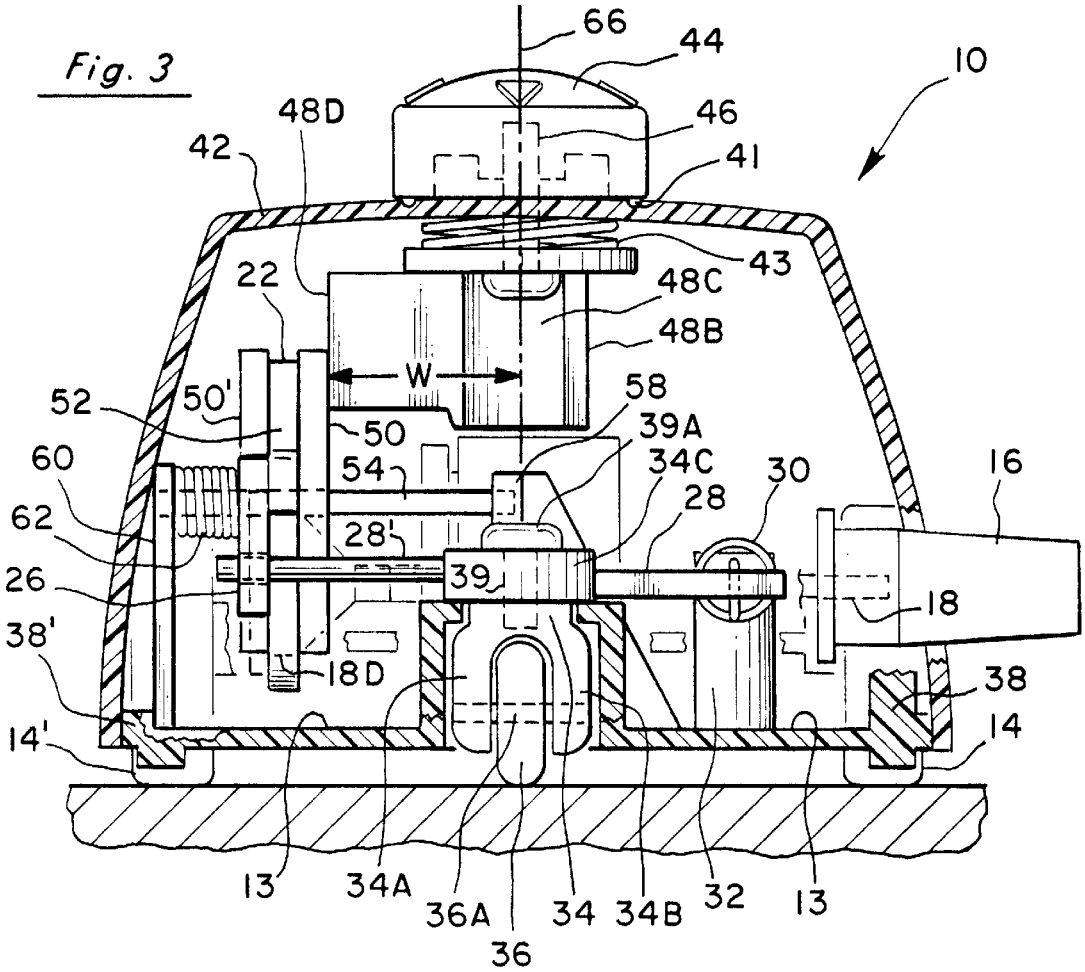
FIG. 3 is a front, cut away, view of the toy automobile of FIG. 1 showing how its guide wheel is attached to a pivotally mounted guide wheel steering arm.

FIG. 3 is a front, cut away, view of the toy automobile 10 as seen along cut away line 3—3 of FIG. 1. FIG. 3 depicts how the toy automobile 10 rides on guide wheel 36 rather than upon its nominal front wheels 38 and 38'. Indeed, these nominal front wheels can be molded as part of the body of the toy automobile 10 since they need not even function as wheels. Guide wheel 36 is shown rotatably mounted on an axle 36A in a guide wheel mounting post 34 having two wheel supports 34A and 34B that support axle 36A. The upper end of guide wheel post 34 is rigidly connected to the pivotally mounted guide wheel steering arm 28 which, in turn, is pivotally mounted to the automobile by means of a pivotally mounted center post 39 in a bearing system 39 (of a type known to those skilled in this art) that permits pivotal rotation of the guide wheel post 34 as the pivotally mounted guide wheel steering arm 28 (that is rigidly connected to guide wheel post 34) is rotated in one direction by the pulling force created by coil spring 30, or in the opposite direction by the pulling force created by the lever arm 22 as it is pulled backward by the various camming surfaces 18A, 18B, 18C and 18D with which the yoke end 20 of lever arm 22 cammingly engages. FIG. 3 also illustrates how a given selector knob cam having a width W (as measured from center line 66 of post 46 to the cam's face e.g., to the face of cam 48D) that will cause the lever arm 22 to come into alignment with one of the cam surfaces on cam shaft 18. Regardless of the width W of any given selector knob cam, that given cam will abut against guide 50 by virtue of the fact that a lateral biasing force produced by spring 62 will force guide device 50 (and hence lever arm 22) toward mounting post 58 until guide device 50 abuts against the face of that given selector knob cam whatever its width W.

Figure 8:
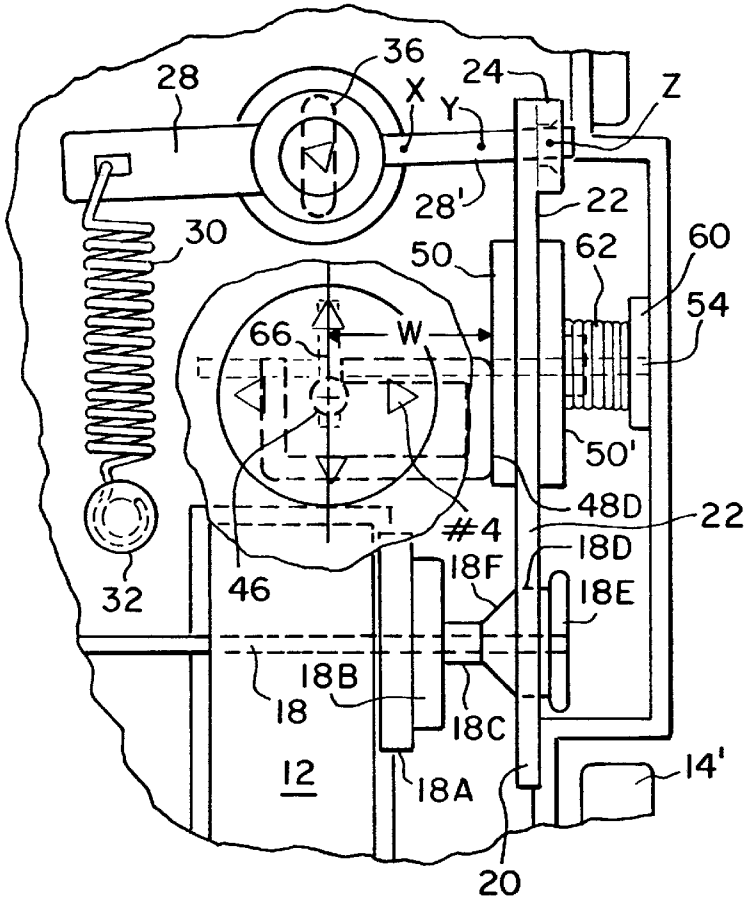
FIG. 8 is a plan view of the toy automobile shown in FIG. 2 with its steering mechanism in a fifth operating position whereby the automobile is steered in a substantially straight forward direction.

FIG. 3, generally depicts the guide wheel 36 being guided in a straight ahead direction. This is achieved by virtue of the fact that the yoke-end 20 of lever arm 22 is cammingly riding over cam surface 18D of powered cam shaft 18. FIG. 8 will depict, in plan view, how this straight forward movement is brought about by the fact that the diameter of camming surface 18D is such that the lever arm 22 pulls the pivotally mounted guide wheel steering arm 28 in an orientation that is substantially parallel to the rear axle 14A of the toy automobile 10. As a final comment concerning FIG. 3, it should also be noted that selector knob 44 may be provided with a locking device (e.g., a nub/detent system 41) and a locking spring device 43 that can be used, in ways known to this art, to hold the selector knob 44 in a given operating position #1, #2, #3, #4, etc. The locking actions supplied by such a locking device should, however, be such that their forces can be manually overcome (even by a child) in order to turn the selector knob 44 to another desired operating position.

FIG. 4 is a cut-away, plan, view of the toy automobile 10. It depicts the guide wheel 36 being steered in a rightward direction. This results from the fact that selector knob 44 is in operating position #1. Position #1 is that operating position that forces selector knob cam surface 48A into abutting contact with the left side of guide device 50. This abutting contact is aided and maintained by the counter biasing action produced by lateral coil spring 62. This lateral biasing action, in effect, is directed away from post 60 and forces guide device 50 against lever arm 22 which, in turn, is forced to maintain an abutting contact with guide device 50 which, in turn, is forced into abutting contact with selector cam surface 48A. The lateral biasing force produced by spring 60 will assure that lever arm 22 receives a lateral force from whichever cam (48A, 48B, 48C or 48D) is placed in contact with guide device 50 when selector knob 44 is turned to any given operating position (#1, #2, #3 or #4). Again, the selection of operating position #1 depicted in FIG. 4 has caused cam surface 48A to be forced into abutting contact with guide device 50 such that lever arm 22 is in alignment with cam surface 18A of the powered cam 18.

In a particularly preferred embodiment of this invention, lever arm 22 will reside between a round, plate-like guide device 50 and a round, plate-like guide device 50'. Regardless of the shape of these guides, lever arm 22 is moved laterally (toward, or away from, post 60) as these guides 50 and 50' are moved laterally by the differently sized selector knob cams (48A, 48B, 48C or 48D). In another, somewhat less preferred embodiment of this invention, the lever arm 22 simply rests on the top of the lateral axle 54 upon which the guides 50 and 50 are loosely mounted for lateral movement. However, in a more preferred embodiment of this invention, (that is more fully illustrated in FIG. 9), lever arm 22 is provided with a lower body region 22A that has a slotted opening 22B in which lateral axle 54 is positioned. Thus, in this more preferred embodiment, guide 50, lever arm 22 and guide 50' are each mounted upon lateral axle 54. Again, in some particularly preferred embodiments of this invention, lever arm guides 50 and 50' will each have round, plate-like, configurations wherein the centers of said plate-like configurations have a round hole through which the lateral axle 54 can easily pass. That is to say that the diameter of each of these round holes should be slightly larger than the diameter of the lateral axle 54 so that the guides 50 and 50' can easily move in either lateral direction on the lateral axle 54 (e.g., toward or away from post 60). Again, if, for reasons hereinafter more fully discussed, the lever arm 22 is also mounted to the lateral axle 54 (rather than merely resting upon the top surface of said lateral axle 54), then said lever arm 22 should be mounted on the lateral axle 54 by means of an extended slot such as the slot 22B shown in FIG. 9. For reasons that will be more fully appreciated after reading subsequent parts of this patent disclosure, this slot 22B should be long enough to permit the lever arm 22 to move to a full forward and to a full backward position when it is placed under certain camming actions.

FIG. 4 also further depicts how lever arm 22 can be moved laterally by different distances (i.e., toward or away from post 60) according to which of the differently sized selector knob cams (48A, 48B, 48C and 48D) is placed in abutting contact with guide device 50. As was seen in FIG. 3, each selector knob cam has a width W such that it forces guide 50—and hence lever arm 22—toward post 60 a distance such that the yoke-end 20 of the lever arm 22 will be aligned with a given cam surface 18A, 18B, 18C or 18D that are serially positioned on the powered cam shaft 18. Hence, each setting #1, #2, #3 or #4 of selector knob 44 will place a given selector knob cam surface 48A, 48B, 48C or 48D in abutting contact with guide 50 at varying distances W that serves to align the lever arm 22 with a given cam surface on the powered cam shaft 18. For example, FIG. 4 depicts position #1 of selector knob 44 positioning cam surface 48A in abutment with guide 50. The width W of cam surface 48A is such that lever arm 22 is aligned with cam surface 18A of the powered cam shaft 18. Thus, the yoke end 20 of the lever arm 22 will cammingly ride over cam surface 18A.

This cam width W and alignment of lever arm 22 with cam surface 18A also serves to place the front end of lever arm 22 toward the left side of the right arm 28' of the pivotally mounted guide wheel steering arm 28. This relationship, in turn, causes the pivotally mounted guide wheel steering arm 28 to be rotated in a clockwise direction about its bearing system 39 under the turning force created by virtue of the fact that lever arm 22 is cammingly engaging with cam surface 18A of cam 18. This clockwise rotation of pivotally mounted guide wheel steering arm 28 also rotates the guide wheel mounting post 34 which is attached to (or is a molded component of) the pivotally mounted guide wheel steering arm 28. Thus, when the guide wheel mounting post 34 is turned clockwise, the guide wheel 36 that is mounted in it (see FIG. 3), also is turned clockwise. Hence, the forward moving toy 10 will be steered in a generally rightward turning direction.

It also might again be noted that, in order for the pivotally mounted guide wheel steering arm 28, to be pivotally rotated to the various positions depicted in this patent disclosure, the front end of the lever arm 22 should be free to slidably move along the first or right side 28' of said steering arm 28. For example, FIG. 2 depicts in its perspective view how a collar 24 having a hole 26 that is larger than the diameter of the right side 28 of steering arm 28 will permit the collar 24 to slidingly move along the right side 28' of said steering arm. Referring back to FIG. 4, it can be seen that the front end of lever arm 22 is contacting the left side of the right side 28' of the pivotally mounted steering arm 28 at or near a point generally designated by the letter X.

Figure 5:
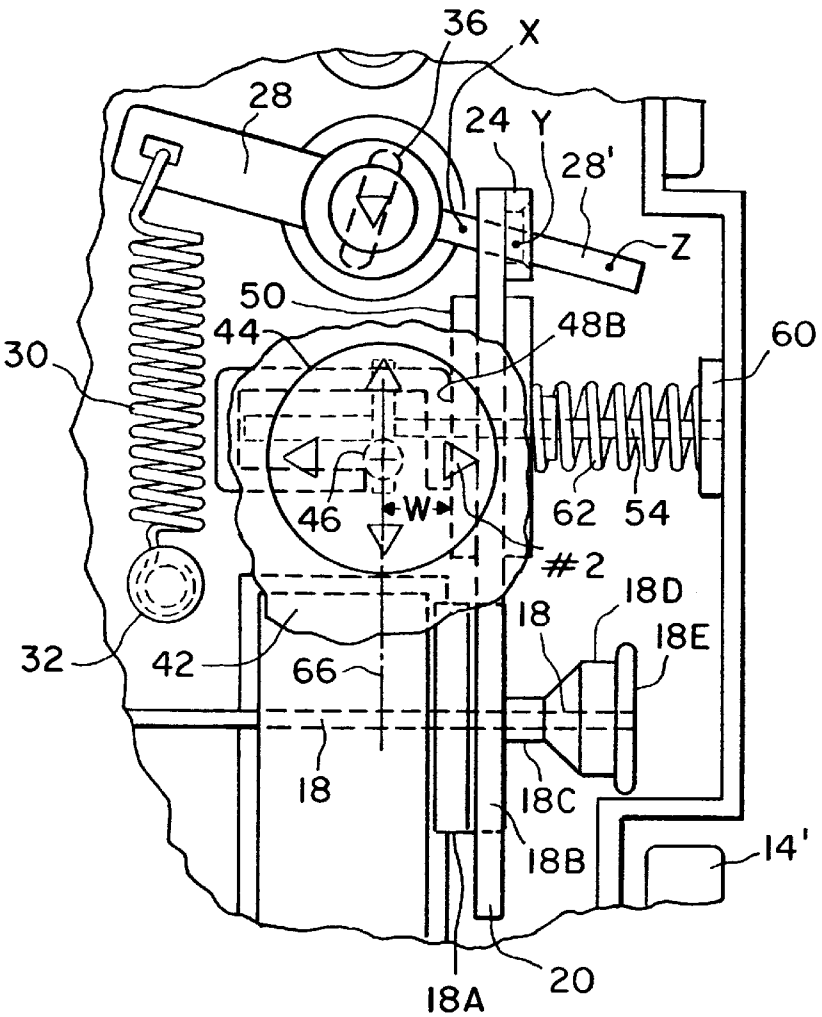
FIG. 5 is a plan view of the toy automobile shown in FIG. 2 with its steering mechanism in a second operating position whereby the toy is steered in a rightward direction that forms a part of an overall, zigzagging, forward travel path.

FIG. 5 illustrates operation of the toy automobile 10 when its selector knob 44 has been manually turned to operating position #2. Selection of this position causes selector knob cam surface 48B to be forced into abutting contact with guide 50. This, in turn, causes lever arm 22 to be aligned with camming surface 18B of powered cam shaft 18. That is to say that the width W of camming surface 48B is such that lever arm 22 is moved laterally toward post 60 a distance such that the yoke-end 20 of lever arm 22 falls into camming engagement with cam surface 18B. As can be better seen in FIGS. 2 and 9, camming surface 18B does not have the round or plate-like configuration of cam 18A, but rather has a bar-like configuration wherein the ends of the bar are generally rounded off. This bar-like cam 18B has a length that preferably approximates the diameter of the contiguous, round, cam 18A. Thus, when the yoke end 20 of lever arm 22 cammingly engages with a long side e.g., long side 18B(1) of cam 18B, (e.g., in the manner shown in FIG. 9), the lever arm 22 is free to be pulled in a forward direction F by a force that is ultimately supplied by the spring 30 that is attached to the left side of the pivotally mounted steering arm 28. As was previously noted, if lever arm 22 is in fact mounted on lateral axle 54, then the lever arm 22 must be so mounted by means of an opening and, preferably, a slot-like opening such as 22B (see FIG. 6) that permits the forward and backward motion suggested by the two headed arrows F/B shown in FIG. 9. Thus, when the inside surface of yoke end 20 of lever arm 22 is cammed against a long surface 18B(1) or 18B(3) of cam surface 18B, the lever arm 22 is pulled to its full forward position by spring 30 and front wheel 36 is steered to the left in the manner generally described in FIG. 6. As the cam 18 continues to be powered in the clockwise direction depicted by the curved arrow shown in FIG. 9, a rounded end camming surface 18B(2) that is associated with the length-defining end of cam 18B comes into camming contact with the inside surface of the yoke-end 20 of the lever arm 22. This camming action overcomes the opposing force being supplied by spring 30 to the pivotally mounted guide wheel steering arm 28 and, hence, lever arm 22 is pulled to its full backward position. In this full backward position, the forward end 22B' of slot 22B would be moved toward the fixed lateral axle 54. Via the connection created between pivotally mounted steering arm 28 and lever arm 22 by collar 34, the pulling action on lever arm 22 by camming surface 18B(2) causes the guide wheel 36 to be steered to the right in the manner generally suggested in FIG. 5. It also should be noted that, while the selector knob 44 is in position #2, yoke-end 20 of lever arm 22 cammingly engages cam 18B in a more or less continuous manner as it rotates under the mechanical powered supplied by spring motor 12. For example, as the powered rotation of cam 18 proceeds, the inside surface of the yoke end 20 of lever arm 22 will cammingly engage with the left long surface 18B(1) of cam 18B (and thereby steering the toy automobile 20 to the left). As cam 18 further continues its powered rotation, yoke end 20 comes into camming contact with camming surface 18B(2) (and thereby steering the toy automobile 10 to the right in the manner suggested in FIG. 5). Still further powered rotation of cam 18 in the clockwise direction depicted in FIG. 9 will cause the inside cam surface of yoke end 20 of lever arm 22 to make the transition from camming contact with cam surface 18B(2) to cam surface 18B(3) and thereby again steering the toy automobile 10 to the left. And, as cam 18B continues to turn, the yoke-end 20 again comes into camming contact with the rounded end 18B(4) of cam 18B (and thereby again steering the toy car 10 to the right). It also should be appreciated that the camming contact transitions made by the inside camming surface of yoke-end 20 of lever arm 22 with cam surfaces 18B(1), 18B(2), 18B(3) and 18B(4) will not be abrupt, but rather will tend to be smoothed out by the continuous camming contact between substantially all of the perimeter of cam 18B (i.e., by its sequential contact with a large part of (or all of) the lengths of cam surfaces 18B(1) , 18B(2) 18B(3) and 18B(4)) Thus, in making the transition from a right turning direction, to a left turning direction, and then back to a left turning direction etc., the forward moving toy automobile will move forward in a series of substantially smooth, zigzagging, curves rather than moving forward in a series of abrupt, or staccato, zigzagging motions. It also might once more be noted that in order to make these smooth transitions, the collar 24 on the front end of lever arm 22 must be able to easily slide from one contact position to another along the right side 28' of steering arm 28. For example, FIG. 5 depicts the collar 24 of lever arm 22 having moved from position X to a position generally indicated by the letter Y.

Figure 9:
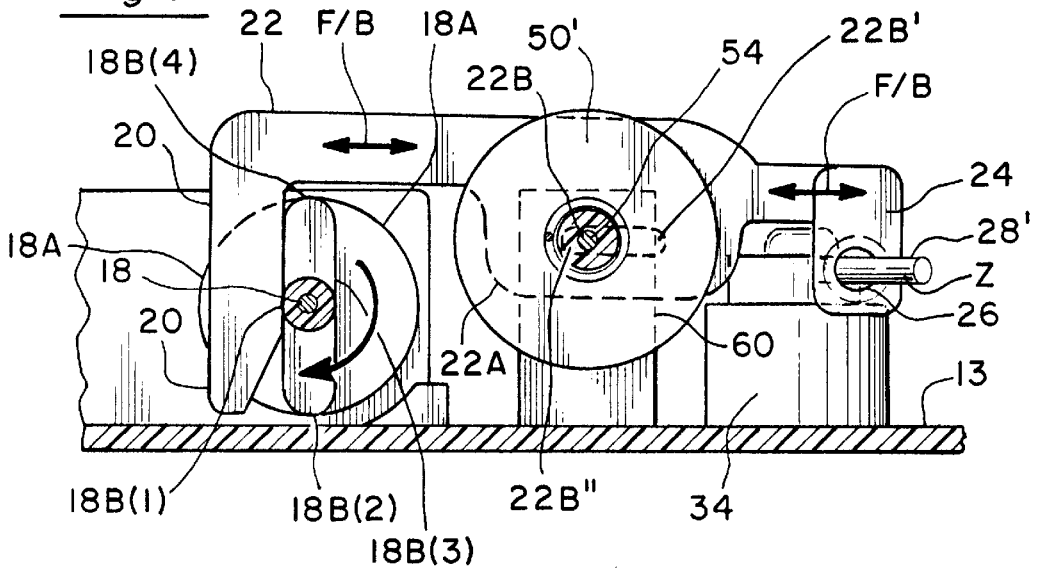
FIG. 9 is a side view of a portion of the steering mechanism that is shown in the operating position depicted in FIG. 6 as seen along section line 9—9.

FIG. 6 depicts wheel 36 being steered in the leftward turning aspect of the smooth, zigzagging course traveled by this toy when the yoke-end 20 of lever arm 22 is in full camming engagement with the long surface 18B(1) of cam 18B. In FIG. 6, the pivotally mounted guide wheel lever arm 28 is shown rotated (by the action of spring 30) in a counterclockwise direction—and thereby steering guide wheel 36 in a generally leftward turning direction. Again, the view seen along section line 9—9 in FIG. 6 is depicted in FIG. 9. In any case, the leftward turning action illustrated in FIG. 6 will be followed by a rightward turning action (a la that depicted in FIG. 5) as the yoke-end 20 of lever arm 22 goes from camming contact with cam surface 18B(l) to camming contact with cam surface 18B(2). This rightward turning action, in turn, is followed by another rightward turning action as yoke-end 20 again comes into camming contact with cam surface 18B(3) and so forth to produce a forward zigzagging, travel path.

FIG. 7 shows the toy automobile 10 with its pivotally mounted guide wheel steering arm 28 being rotated in a counterclockwise direction. A continuous, leftward turning action is produced on wheel 36 by this particular counterclockwise turning of the pivotally mounted guide wheel steering arm 28. This continuous leftward turning action follows from the fact that selector knob 44 is in operating position #3. In this particular operating position, selector knob cam 48C is forced into abutting contact with guide device 50. This contact, in effect, positions lever arm 22 in alignment with cam surface 18C. Since cam surface 18C has a round cross sectional configuration, there is no forward nor backward motion (such as that depicted by the arrows F/B in FIG. 9) of the lever arm 22 as there was in the case of the yoke end 20 being in camming contact with the rotating, bar-like cam 18B. Thus, selection of position #3 on selector knob 44 will cause the toy automobile to permanently turn to the left in a substantially circular travel path.

FIG. 8 depicts the selector knob 44 in operating position #4. This operating position places selector knob cam 48D in abutting contact with guide device 50. This, in turn, places lever arm 22 in alignment with camming surface 18D of cam shaft 18. In other words, the width W between the center line 66 of the selector knob post 46 and the guide device 50 is such that lever arm 22 is forced toward post 60 to an extent such that the yoke end 20 of lever arm 22 is aligned with cam surface 18D. A stop 18E is shown provided on the end of cam surface 18D in order to prevent the yoke end 20 of lever arm 22 from going too far to the right and slipping off the right side of cam surface 18D as it turns. In another preferred embodiment of this invention, a transition camming surface 18F can be provided to assist the yoke end 20 in making its transition movement from cam surface 18C to cam surface 18D.

Be that as it may, cam surface 18D is shown having a round cross section. This round cross section is preferably larger in diameter than the diameter of the round cross section of cam surface 18C, but smaller than the cross sectional diameter of round cam surface 18A. The diameter of cam surface 18D is such that when the yoke end 20 of lever arm 22 cammingly engages with cam surface 18D, lever arm 22 is pulled backward to an extent such that the pivotally mounted steering arm 28 has an orientation that is more or less parallel to the axis of the powered cam shaft 18. Consequently, this orientation of the guide wheel steering arm 28 causes guide wheel 36 to be guided in a substantially straight forward direction. It also should be noted that in the mode of operation illustrated in FIG. 8, collar 24 of lever arm 22 has slidingly moved to a position generally designated by the letter Z on the right side 28' of the pivotally mounted guide wheel lever arm 28.

FIG. 9 is a cross sectional view as it would be seen along section line 9—9 of FIG. 6. It depicts the inside camming surface of the yoke end 20 of lever arm 22 in full camming contact with a long axis side 18B(l) of the bar-shaped cam 18B. The general contour of this bar-shaped cam 18B can also be seen in the perspective view provided by FIG. 2. As previously noted in the discussion of FIGS. 5 and 6, when the lever arm 22 is in association with cam 18B, it must move with a reciprocating, forward and backward motion F/B as the various cam surfaces 18B(1), 18B(2), 18B(3) and 18B(4) of cam 18B come into, and go out of, camming contact with the inside camming surface of the yoke end 20 of lever arm 22 in order to produce a smooth, forward moving, zigzagging travel path.

Those skilled in this art will appreciate that many modifications could be made in the moving toys that have been used to illustrate this patent disclosure without departing from either its scope or its spirit. For example, the powered cam shaft could be provided with more (or fewer) cam surfaces than the four camming surfaces used to illustrate this invention. Moreover, any of these cam surfaces could have been shown with cross sectional configurations (e.g., oval configured cross sections) that could be different from the round and bar-like configurations that were used to illustrate some of the possible movements that can be made by the moving toys of this patent disclosure.

Thus, having disclosed our invention, we claim:

1. A moving, toy comprising:

(1) a vehicle body;

(2) a manually operated selector knob that (i) is mounted on the vehicle body and (ii) has multiple operating positions that are respectively mechanically associated with a given selector knob cam;

(3) a motor that (i) is geared to at least one rear wheel whose powered rotation propels the toy forward and (ii) drives a powered cam shaft having multiple cam surfaces;

(4) a level arm having (i) a rear end that cammingly engages with a given cam surface on the powered cam shaft, (ii) a front end that slidingly engages with one end of a pivotally mounted guide wheel steering arm and (iii) a middle region whose one side receives a lateral force emanating from a given selector knob cam associated with the manually operated selector knob and whose other, opposing, side receives force emanating from a lateral bias device;

(5) a pivotally mounted guide wheel steering arm having (i) a pivotally mounted center post, (ii) a first arm that slidingly engages with the front end of the lever arm and (iii) a second arm that is connected to a rearward biasing device and wherein the pivotally mounted center post is mechanically connected to a guide wheel mounting post that contains a guide wheel, and (6) a guide wheel that supports the toy and guides it in a direction determined by an operating position of the manually operated selector knob.

2. The moving toy of claim 1 wherein the motor is a spring powered motor.

3. The moving toy of claim 1 wherein the motor is a battery powered motor.

4. The moving toy of claim 1 wherein the multiple cams of the powered cam shaft include, in sequence, a first, round camming surface having a given cross sectional diameter, a bar-like camming surface, a second, round camming surface that has a cross sectional diameter less than the given cross sectional diameter of the first, round camming surface and a third, round camming surface having a cross sectional diameter less than that of the first, round camming surface, but greater than that of the second, round camming surface.

5. The moving toy of claim 1 wherein the multiple cams of the powered cam shaft include one that has a bar-like configuration and whose camming action against the rear end of the lever arm causes said lever arm to move backwards and forwards as the bar-like configuration of the cam surface is rotated by said powered cam shaft.

6. The moving toy of claim 1 wherein the lever arm is provided with a slot in which the lever arm can be moved forward and backward with respect to a lateral axle.

7. The moving, toy of claim 1 wherein the lateral bias device is in the form of a coil spring that is mounted on a lateral axle.

8. The moving, toy of claim 1 wherein the rearward biasing device is in the form of a coil spring that is attached to the pivotally mounted guide wheel steering arm.

9. The moving toy of claim 1 wherein the lever arm resides between a first guide that is loosely mounted on a lateral axle and which receives force from a selector knob cam device and a second guide that is loosely mounted on the lateral axle and which receives a force from a coil spring that opposes a force from a given selector knob cam.

10. The moving toy of claim 1 wherein the rear end of the lever arm has a yoke-like configuration.

11. The moving toy of claim 1 wherein the front end of the lever arm is provided with a collar through which one side of the pivotally mounted guide wheel steering arm is free to slide.

12. The moving toy of claim 1 wherein said toy has the general appearance of an automobile.

* * * * *